United States Patent [19]

McKnight

[11] Patent Number: 4,753,573

[45] Date of Patent: Jun. 28, 1988

[54] FILTERING MEANS FOR CEILING FAN BLADES

[76] Inventor: Charles A. McKnight, 800 Medical Towers, Little Rock, Ark. 72207

[21] Appl. No.: 29,652

[22] Filed: Mar. 23, 1987

[51] Int. Cl.[4] ..... B63H 1/00

[52] U.S. Cl. ..... 416/62; 55/511; 55/514; 55/316; 55/467; 416/146 R

[58] Field of Search ..... 55/316, 279, 400, 387, 55/467, 504, 522, 528, 501, 511, 574; 416/62, 146 R; 156/306.6

[56] References Cited

U.S. PATENT DOCUMENTS

| | | | |
|---|---|---|---|
| 2,415,621 | 2/1947 | Arnhym | 55/467 |
| 2,988,169 | 6/1961 | Klein | 55/514 |
| 3,019,127 | 1/1962 | Czerwonka | 55/316 |
| 3,417,552 | 12/1968 | Dyer et al. | 55/528 |
| 3,458,130 | 7/1969 | Juhlin | 55/511 |
| 3,487,625 | 1/1970 | Lucas | 55/514 |
| 4,340,402 | 7/1982 | Catron | 55/528 |
| 4,540,625 | 9/1985 | Sherwood | 55/528 |

FOREIGN PATENT DOCUMENTS

| | | | |
|---|---|---|---|
| 196337 | 10/1986 | European Pat. Off. | 55/400 |
| 52276 | 4/1977 | Japan | 55/387 |

*Primary Examiner*—Bernard Nozick

*Attorney, Agent, or Firm*—Haverstock, Garrett & Roberts

[57] ABSTRACT

An air filter for attaching to a top and/or bottom surface of a fan blade. The air filter is constructed from an elongated strip of porous material capable of having air pass therethrough while trapping airborne particles borne by the air. Also, the elongated strip has opposed exposed surfaces and a peripheral edge extending therearound and preferably, an adhesive strip having opposite surfaces and an adhesive substance on each of the opposite surfaces is attached to one side edge of the elongated strip. The other opposed surface of the adhesive strip is preferably attached to a top and/or bottom surface of a fan blade. Thus, the filter strip sweeps and filters air moving across the one surface of the fan blade as the fan blade rotates.

16 Claims, 1 Drawing Sheet

FILTERING MEANS FOR CEILING FAN BLADES

This invention relates to air filtering means, and more particularly to air filtering means which are adapted to be attached to the top and/or bottom surfaces of the blades of a ceiling fan. Known air filter units which have been designed for use with ceiling fans require specially designed fan blades which complicates their construction and generally require more power to operate. One example of such is shown in Eisenhardt, Jr. U.S. Pat. No. 4,422,824 which discloses an air filter unit for use with a ceiling fan that has specially designed hollow fan blades. In the Eisenhardt, Jr. device, filtering pads are mounted on the vertical side surfaces of hollow fan blades and a germicidal light is mounted within the hollow portion of each of the fan blades. Thus, the Eisenhardt, Jr. type fan blades are very complicated structurally, are relatively heavier than more conventional fan blades and require greater power to rotate them. Other patents disclose other type air filter units including disclosing means to move an air filter through air rather than forcing air through a stationary filter. However, these air filter units are not designed or adaptable for being attached to the top and/or bottom surface of ceiling fan blades and therefore are of general interest only. See For Examples U.S. Pat. Nos. 4,411,675, 3,676,985 and 3,126,263.

The present construction provides novel air filtering means which can be removably attached to the top and/or bottom surfaces of conventional ceiling fan blades, and each such filter includes a porous filter strip which may have many various shapes but generally has an elongated rectangular shape. The filter strips may be made from various porous filtering materials and preferably the porous material should be of a fine enough mesh to catch particles in the air as the air passes through and to produce minimum resistance to the air flow therethrough. A particularly useful material for making the present filter strips is an open pore polymeric foam such as a polyurethane foam. The filter strips can also be constructed from a shreaded polymer such as shreaded polyethylene which would also catch dust particles and may also have an electrostatic attraction for certain types of airborne particles. The material from which the elongated filter strips of the present invention is constructed may also have an odor absorbing material such as charcoal or other substance embedded in or applied thereto. Such an odor absorbing material may be impregnated in the foam or it may be present as a separate layer of material. The materials used with the present construction, however, should be relatively inexpensive so that it is economic to use them and to periodically replace them. The material may also be washable so that the filter strips can be removed, washed and reinstalled for use. The novelty of the present filter construction resides primarily in the construction of the filters themselves and attachment means for attaching them to fan blades.

The present filter strips can be attached to fan blades by various means, although the preferred attachment means is to attach an adhesive strip having a precoated adhesive covered by a removable cover layer to one side edge of the strips. When the removable covers are removed, the filters can be attached on edge to the surfaces of the blades so that they stand out from the blades and will sweep a fairly large volume of air as the blades rotate. Mainly for cosmetic reasons, it will usually be preferred to install the present filter elements on the top surfaces of fan blades where they are not as readily seen.

The present filter strips are sufficiently rigid that they remain upright and move through the air without deforming or collapsing and without requiring added support. This is accomplished by constructing the present filter strips of a material that is relatively stiff and of desired porousness to air flow. Thus, the present filter strips will provide sufficient self-support to withstand the forces which it will encounter at various fan speeds and will remain substantially upright as the fan blades having the filter strips attached to them rotate. For example, when using the present filter strips at relatively high speeds they should be relatively less porous and/or extend relatively less far upward or downward from the surface of the fan blades to which they are attached in order to keep the filter strips from excessive deforming or collapsing. However, when used at lower speeds, the filter strips can be made to be relatively more porous and/or they may stand out further from the surfaces of the fan blades to which they are attached. Keeping the subject filter strips upstanding or substantially upstanding during rotation is important to their operation because by doing so they will sweep and filter more air.

It has been discovered that fan blades equipped with the present air filters move through the air with relatively little additional resistance and the filter strips are effective in removing dust and other particles from the air and in some cases if treated can also remove or produce odors. It has also been found that little or no extra horsepower is required to rotate fan blades equipped with the subject filters. The fact that the subject filters can be installed almost totally out of sight is another significant advantage. This cosmetic advantage is especially important when installing the devices on fans in certain locations such as in homes, restaurants and like places.

It is therefore a principle object of the present invention to provide an air filter device which can be attached to a top and/or bottom surface of a ceiling fan blade to remove dust and other matter from the air as the blade rotates.

Another object is to provide an easily replaceable air filter device for attaching to rotatable fan blades.

Another object is to provide a relatively simple, inexpensive and easy to install and replace filtering means for use with ceiling fans.

Another object is to provide an inexpensive way to remove dust and other unwanted particles from the air.

Another object is to provide a relatively light weight air filter which presents minimal resistance to air flow therethrough.

Another object is to provide simple means for attaching an air filter to a ceiling fan blade without modifying the fan blade.

Another object is to provide an air filter which when rotating with a fan blade filters a relatively large volume of air presented thereto by the action of the fan blade.

These and other objects and advantages of the present invention will become apparent to those skilled in the art after considering the following detailed specification which discloses several representative embodiments of the present air filters in association with ceiling fans as shown in the accompanying drawings, wherein:

DETAILED DESCRIPTION OF THE PREFERRED EMBODIMENTS

Figure 3:
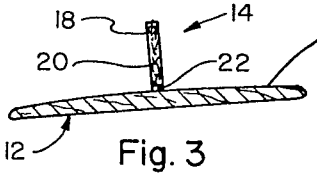
FIG. 3 is a cross-sectional view taken on line 3—3 of FIG. 2.
Figure 1:
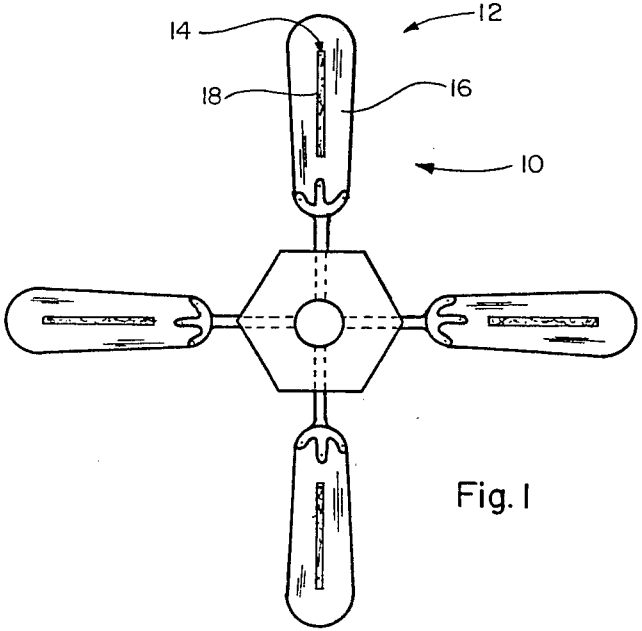
FIG. 1 is a top view of a ceiling fan assembly having one of the present air filter devices attached to each of the fan blades thereof.

Referring to the drawings more particularly by reference number, FIG. 1 shows a ceiling fan assembly 10 having four similar fan blades 12. Each of the fan blades 12 is shown having one of the present air filter devices 14 centrally located on its upper surface 16 and removably attached thereto. The air filters 14, could be located elsewhere on the upper and/or lower blade surfaces although for cosmetic reasons it is usually preferred to mount them on the upper surfaces where they are not easily seen from below. Therefore, the embodiment shown in FIG. 1 generally is the most desirable when the present filter devices are to be used on fans located in the home, the office, in restaurants or other like locations and where the cosmetics may be important. The filters 14 are formed of filter strips 18 which have side faces usually rectangular in shape although they could have other shapes as well. Importantly the filter strips 18 are relatively rigid and porous and remain upstanding when the blades rotate and are able to filter relatively large amounts of air fed thereto by the action of the blades themselves. The air filters 14 are generally relatively light weight and are constructed from an open pore material such as from a polymeric foam 20 as shown in FIG. 3 which is of a fine enough mesh to permit air to pass through while trapping dust and other particles as the fan blades air filters rotate. The filters 14 may also be impregnated with charcoal or some other suitable substance such as an air freshner which will absorb odor or scent the air.

Figure 2:
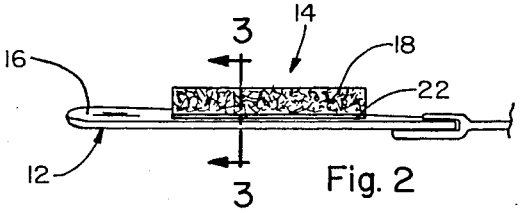
FIG. 2 is a side view of one of the fan blades of the assembly of FIG. 1 showing one of the present air filter devices attached thereto.
Figure 4:
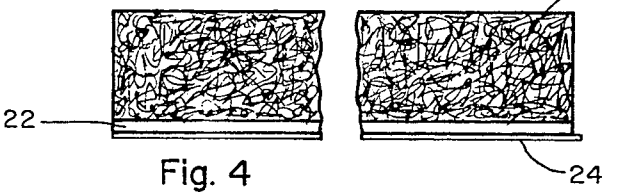
FIG. 4 is an enlarged side view of one of the present air filters.
Figure 5:
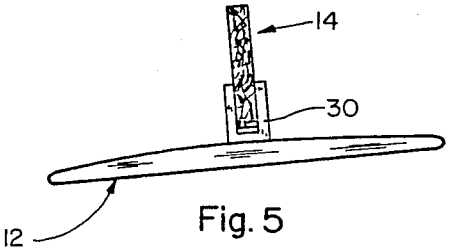
FIG. 5 is an enlarged cross-sectional view similar to FIG. 3 showing a modified form of the subject device.

As shown in FIG. 2, the air filter 14 is adhesively attached to the fan blade 12 by a double sided adhesive strip 22, one side of which is attached to an edge of the filter strip 18 and the other side to the surface 16 (upper surface) of the fan blade 12. The filter 14 is shown centrally located (FIGS. 1 and 3) on the surface 16 mainly to make it less visible from below. The adhesive strip 22 should have a length and shape which corresponds to the length and width of the side edge of the filter to which it is attached. The use of the adhesive strip 22 for attaching the filter strip 18 to the fan blade 12 as shown in FIGS. 2, 3 and 4 is preferred over other types of attachment means because it provides simple and easy attachment of the filter strip 18 to the fan blade 12 and also provides simple and easy detachment for replacement or cleaning. However, other forms of attachment means could be used including the use of glues or adhesives for attaching directly to the fan blade or even mechanical attachment means such as using channel member 30 (FIG. 5) with or without fasteners. Although other means could be used to attach the filters to the fan blades, the use of double sided adhesive strips as described is preferred because they are relatively easy to use and do not require tools or other equipment. For manufacturing and handling purposes, the outer adhesive side of the adhesive strips 22 are covered by a removable protective strip 24 which is placed over the adhesive strip 22 when the filter 14 is manufactured. The protective strip 24 remains over the adhesive 22 until the filter 14 is to be used. Thus, when a user wants to attach the filter unit 14 to a fan blade, the protective strip 24 is removed thus exposing an adhesive surface of the adhesive strip 22 for attaching the filter to the blade.

The filters 18 should be constructed of a relatively stiff porous material so that as they move easily through the air, will remain upstanding on the blade, and will not deform or collapse and lose their effectiveness. This is accomplished by constructing the filters of an open mesh porous material of the desired size, shape, width, length and thickness and yet able to be self supporting when attached on edge even in the face of the wind force applied thereto as the fan blades rotate. A suitable material for this purpose is an open pore polymeric foam material 20. A typical filter has a thickness of about 1/5 inch, a width of about 1¼ inches, and a length of about 6 inches. All of these dimensions can be varied considerably depending on the size of the fan blades, the anticipated speed of rotation, and the porousness of the material used. For example, a more porous material produces less resistance to air passage therethrough than a less porous material. The same considerations apply to selecting the desired dimensions for the filters. Keep in mind also that a less porous material is likely to do a better job of filtering than a more porous material if the air can pass through, and if the filter is treated with charcoal or some other chemical or odor producing material this may effect its filtering characteristics.

It is important to the operation of the present filters as noted, that they remain as upstanding as possible during rotation in order to filter the maximum amount of air. If the filters 18 were to deform or collapse during rotation, it would adversly effect their ability to filter the air. Also, since the present filters are relatively lightweight it has been experienced that they produce relatively little drag on the fan and fan motor. Thus, the regular fan motor without alteration can be used to operate the fan.

In FIG. 1, one of the present air filters is shown attached to each of the blades of the fan in order to keep the blades in balance and to filter the most possible air. However, the filters could be attached to less than all the blades, if desired, without departing from the invention. It is usually desired, however, to use enough properly located filters so that the fan does not become unbalanced. For a four bladed fan this means attaching filters to both blades of at least one opposed pair. For a five bladed fan, filters should be attached to all of the blades for best operation.

Thus, there has been shown and described novel means for filtering air flowing past the blades of a fan such as a ceiling fan, which filtering means fulfill all the objectives and advantages sought therefor. It will be apparent to those skilled in the art, however, that many changes, modifications, variations and other uses and applications are possible, and all such changes, modifications, variations and other uses and applications which do not depart from the spirit and scope of the invention are deemed to be covered by the invention which is limited only by the claims which follow.

What is claimed is:

1. An air filter attached to a surface of a fan blade which has relatively wide opposite surfaces comprising an elongated strip of relatively thin rigid porous material capable of having air pass therethrough while trapping airborne particles borne by the air, said strip being relatively thin compared to the width of the surfaces of the fan blade and being defined by exposed opposite planar surfaces and a peripheral edge extending therearound, attachment means located on the peripheral edge along one side of the strip attaching the strip in an upstanding position extending outwardly substantially normal to one of the opposite surfaces of the fan blade to which it is attached and from an intermediate position of said one opposite surface of the fan blade whereby at least one of the planar opposite strip surfaces sweeps air moving over the one surface of the fan blade to which it is attached during rotation of the fan blade.

2. The air filter of claim 1 wherein said elongated strip is constructed from an open pore polymeric foam material.

3. The air filter of claim 1 wherein said elongated strip is constructed from shreaded polyethylene.

4. The air filter of claim 1 wherein said elongated strip has an odor absorbing material impregnated therein.

5. The air filter of claim 1 wherein said elongated strip has a substantially rectangular cross-sectional shape.

6. The air filter of claim 1 wherein the attachment means are adhesive attachment means.

7. The air filter of claim 6 wherein the adhesive attachment means include an adhesive strip having opposite surfaces and adhesive substance on each of said opposite surfaces, the adhesive on one of said opposite surfaces being attached to the one side edge of the elongated strip and the adhesive on the other opposite surface for attaching to a surface of a fan blade.

8. The air filter of claim 7 including a removable protective member covering the adhesive on the other opposite surface of the adhesive strip.

9. Air filtering means in combination with a ceiling fan unit comprising a filter strip, said filter strip being a relatively thin rigid planar member having opposite surfaces and at least one substantially straight side edge and being constructed from a relatively porous material, and an elongated tape having opposite surfaces each having an adhesive thereon, one surface of said tape being adhesively attached to said filter strip along the straight side edge thereof, the opposite surface of said tape attaching the filter strip on edge to an intermediate location on a fan blade whereby the strip stands out from the blade substantially normal to the surface to which it is attached so that said strip can sweep and filter air moving over the blade and against one of the planar surfaces of the strip as the blade rotates.

10. The air filtering means of claim 9 including a removable protective member covering the adhesive on one surface of said tape.

11. The air filtering means of claim 9 wherein said filter strip is constructed of a polymeric open pore foam material.

12. The air filtering means of claim 9 wherein said filter strip is constructed from shreaded polyethylene.

13. The air filtering means of claim 9 wherein the filter strip is impregnated with a charcoal material.

14. The air filtering means of claim 9 wherein said filter strip is substantially rectangular in shape.

15. The air filtering means of claim 9 wherein the filter strip is impregnated with an odor absorbing material.

16. Air filter means attached to a surface of a fan blade comprising a relatively thin rigid member constructed of a porous material, said member having closely spaced planar opposite surfaces which permit air to pass therethrough and a peripheral side edge, one portion of which includes means attaching the member on edge to the surface of the fan blade in an upstanding position extending outwardly therefrom substantially normal to the surface of the fan blade to which it is attached and at an intermediate location on the blade surface whereby some of the air moving over the blade and against one of the planar surfaces of the planar member when the blade rotates will pass therethrough and be filtered.

* * * * *